US006315426B1

(12) United States Patent
Buller, Jr.

(10) Patent No.: US 6,315,426 B1
(45) Date of Patent: Nov. 13, 2001

(54) SHOULDER MOUNTED FLASHLIGHT HOLDER

(75) Inventor: Dennis P. Buller, Jr., Willington, CT (US)

(73) Assignee: Dennis Buller, Willington, CT (US)

( * ) Notice: Subject to any disclaimer, the term of this patent is extended or adjusted under 35 U.S.C. 154(b) by 0 days.

(21) Appl. No.: 09/531,554

(22) Filed: Mar. 20, 2000

(51) Int. Cl.[7] ..... A45F 3/14

(52) U.S. Cl. ..... 362/108; 362/103; 362/197; 362/190; 362/191; 362/287; 362/427; 362/419; 362/422

(58) Field of Search ..... 362/103, 108, 362/197, 190, 191, 287, 427, 419, 422; 2/45, 92, 102, 913, 905, 209.13

(56) References Cited

U.S. PATENT DOCUMENTS

| | | | | |
|---|---|---|---|---|
| 295,982 | | 4/1884 | Conwell . | |
| 1,717,386 | | 6/1929 | Kaplan . | |
| 2,275,765 | | 3/1942 | Hummert et al. . | |
| 2,361,414 | | 10/1944 | Ramsey . | |
| 2,506,685 | | 5/1950 | Sadloski et al. . | |
| 2,555,871 | | 6/1951 | Caggiano . | |
| 3,731,084 | * | 5/1973 | Trevorrow | 362/190 |
| 4,328,533 | * | 5/1982 | Paredes | 362/103 |
| 4,998,187 | * | 3/1991 | Herrick | 362/103 |
| 5,103,384 | * | 4/1992 | Dorhan | 362/191 |
| 5,383,633 | * | 1/1995 | Ellestad | 362/103 |
| 5,658,065 | * | 8/1997 | Jamieson | 362/106 |
| 5,664,868 | * | 9/1997 | Montalbano et al. | 362/105 |
| 5,690,413 | | 11/1997 | Coughlin . | |
| 5,690,416 | * | 11/1997 | Van Gennep | 362/191 |
| 5,779,348 | * | 7/1998 | Interlicchio | 362/108 |
| 5,823,658 | * | 10/1998 | Doddy | 362/191 |
| 5,892,445 | | 4/1999 | Tomich . | |
| 5,921,664 | | 7/1999 | Lee . | |
| 6,015,217 | * | 1/2000 | Colangelo et al. | 362/103 |
| 6,062,700 | * | 5/2000 | Price | 362/103 |
| 6,095,657 | * | 8/2000 | Kent | 362/108 |
| 6,109,761 | * | 8/2000 | Smith et al. | 362/108 |

FOREIGN PATENT DOCUMENTS

| | | |
|---|---|---|
| 646257 | 8/1962 | (CA) . |
| 854607 | 4/1940 | (FR) . |

* cited by examiner

*Primary Examiner*—Stephen Husar
*Assistant Examiner*—Anabel Ton

(57) ABSTRACT

A shoulder mounted flashlight holder provides for the hands free holding of a flashlight by the wearer thereof, enabling the wearer or user of the device to perform a task using both hands while keeping the area of interest illuminated. The present holder comprises a rigid, curved shoulder plate which extends over one shoulder and downwardly in front of and in back of the shoulder. The plate includes a spherical swivel base, providing for the adjustment of the aim of a flashlight secured thereto as desired. The plate is well padded for the comfort of the user, and includes forward and rearward extensions for the attachment of a torso encircling belt or strap, for securing the shoulder harness portion. The encircling belt extends from the rear portion of the shoulder harness, around the torso of the wearer to attach to another strap depending from the front of the shoulder harness. A flashlight is removably secured in a rigid channel, which is in turn adjustably secure to the spherical swivel base by a mating ball connection. The assembly may be locked in position as desired. The flashlight is secured in the channel by an elastomer fabric sleeve which fits securely about the body of the flashlight to hold it in place in the channel. The flashlight switch is readily operable through the resilient elastomer fabric material. The user secures the harness and belt over the shoulder and about the torso to secure a flashlight for hands free illumination of a task.

19 Claims, 4 Drawing Sheets

SHOULDER MOUNTED FLASHLIGHT HOLDER

BACKGROUND OF THE INVENTION

1. Field of the Invention

The present invention relates generally to bodily mounted and attached articles and supports therefor, and more specifically to a shoulder mounted device for holding a flashlight or the like. The present holder provides solid, hands free support for a flashlight or similar device, yet is easily donned and removed as desired. The present holder also provides for adjustment as desired of the aim of a flashlight held therein, and ease of attachment and removal of the flashlight thereto.

2. Description of the Related Art

Supplemental lighting for various tasks is often important, and the conventional flashlight has proven to be a very practical response to the problem of providing supplemental lighting. However, in many instances the person requiring the supplemental lighting must use both hands to accomplish the task at hand, thus obviating the use of a hand held light. Responses to this problem are old in the art, as exemplified by helmet mounted acetylene lamps used in the mining industry in the past and more current electrically powered helmet lamps, as well as other similar devices.

However, such helmet mounted lights are generally relatively specialized, and cannot provide the universal function of a conventional dry cell powered flashlight which includes the electrical power source and light source in a single convenient unit. Also, in many instances a hat or helmet including a Light therewith is impractical, depending upon the room or space available for wearing such an appliance, appearance requirements (e. g., military or other uniform, etc.), and/or perhaps other reasons. As a result, various bodily attachable light holders have been developed in the past in response to the above problem. Nevertheless, all of the previously developed devices lack some desired feature (e. g., provision for a conventional flashlight, adjustability, ease of installation and removal of the flashlight, etc.), which is provided by the present flashlight holder.

A discussion of the related art of which the present inventor is aware, and its differences and distinctions from the present invention, is provided below.

U.S. Pat. No. 295,982 issued on Apr. 1, 1884 to James S. Conwell, titled "Band Lamp And Torch Support," describes an upper body mounted support for a combustion type light source (kerosene lamp, etc.). The device includes waist and chest straps as well as suspender straps from which a pair of supports extend to each side of the wearer's head. Various embodiments are shown for attaching the lamp to the supports, but none would be capable of holding a conventional flashlight. Moreover, no means of aiming the light is provided, as the light used with the Conwell device is omnidirectional.

U.S. Pat. No. 1,717,386 issued on Jun. 18, 1929 to Samuel Kaplan, titled "Flash Light Holder," describes a shoulder mounted device having a generally diagonal strap which passes beneath the opposite shoulder, with a brace extending therefrom to fit beneath the shoulder and upper arm. The flashlight is held by a simple clip, which is in turn secured to a base by a gimbal type mount. The Kaplan device does not provide the security of the present flashlight holder, as the bottom of the underarm brace may shift forwardly or rearwardly, thus causing the attached strap to shift about the upper body of the wearer and causing the shoulder mounted light holder to shift accordingly. Also, the gimbal mount used by Kaplan does not provide ease of loosening or tightening for adjustment, as does the spherical mount adjustment of the present flashlight holder apparatus.

U.S. Pat. No. 2,275,765 issued on Mar. 10, 1942 to Robert H. Hummert et al., titled "Portable Light," describes an upper body harness for securing a battery pack to the back of the wearer, with a relatively large spotlight electrically connected thereto. The spotlight hangs loosely on the front of the harness when not in use, but no means for holding the light in a fixed direction is provided by Hummert et al.; the light must be aimed by hand, which precludes the use of both hands in performing a task while the light remains focused thereon by a directionally adjustable and lockable attachment, as provided by the present flashlight holder invention.

U.S. Pat. No. 2,361,414 issued on Oct. 31, 1944 to Jesse A. Ramsey, titled "Marine Safety Light," describes several embodiments of an omnidirectional lighting device. At least one embodiment may be secured near the shoulder of a person by means of a clip which is attached to a life vest or other garment. The Ramsey light apparatus is intended as an emergency locator device, so rescuers may spot a person at sea. Ramsey provides only a mercury type gravitationally actuated switch for his light; no manually activated switch is provided as such, other than by orienting the light as desired. As the light is omnidirectional, Ramsey does not provide any means for aiming the light in a specific direction, as provided by the present shoulder mounted flashlight holder invention.

U.S. Pat. No. 2,506,685 issued on May 9, 1950 to Stanley P. Sadloski et al., titled "Shoulder-Supported Flashlight Holder," describes a device having a shoulder mount formed of "heavy rods" (col. 1, l. 44) with a lanyard extending from the shoulder mount around the opposite side of the body and beneath the shoulder; the device does not completely encircle the upper body for positive securing, as does the present flashlight holder apparatus. While Sadloski et al. provide a locking spherical adjustment for aiming and setting the aim of the flashlight held by their device, the open top clip means used to hold the flashlight does not completely encircle the light and does not provide the positive security for the light which is provided by the present shoulder mounted flashlight holder invention.

U.S. Pat. No. 2,555,871 issued on Jun. 5, 1951 to Fiore L. Caggiano, titled "Body Supported Floodlight," describes a harness having a pair of lights extending from the back thereof on flexible "gooseneck" arms. The Caggiano lights are powered by electrical current supplied from a fixed source (e. g., wall outlet, et:c.), and thus an extension cord must be used to supply power to the device. The lights are not quickly and easily removable from their respective gooseneck attachments, whereas the present light is easily removed and replaced from its holder. Moreover, the flexibility of the gooseneck extensions, with the weight of the lights attached to the ends thereof, provides a less secure means of aiming the lights, and particularly of locking the aim as desired, than the locking spherical adjustment of the present flashlight holder invention.

U.S. Pat. No. 3,731,084 issued on May 1, 1973 to Blanche P. Trevorrow, titled "Portable Flashlight," describes a relatively small reading type light which is supported by a pair of separate shoulder braces or mounts. Batteries are contained within at least one of the shoulder mounts, with the light itself located at the distal end of two flexible "gooseneck" type attachments which extend from the two shoulder mounts and join at the light. Thus, the light cannot be separated from its gooseneck attachments or from the shoulder braces. Moreover, the Trevorrow device is not configured for holding a conventional flashlight, as is the present invention, and does not provide the positive locking of the aim of the light by means of a spherical joint, as in the present invention.

U.S. Pat. No. 5,690,413 issued on Nov. 25, 1997 to James Coughlin, titled "Safety Light For Marine Vest," describes a light and battery pack attachment for a conventional life vest or jacket. The lamp has a rearwardly projecting stud which extends through one of the attachment strap passages of the life jacket, and engages a threaded receptacle on a plate on the opposite side of the life jacket panel. The separate battery pack attaches in the same manner. Thus, the Coughlin light is not shoulder mounted and cannot be aimed in a specific direction, except by turning the life jacket panel to which the light is attached, as by turning the upper body while wearing the life jacket. The Coughlin apparatus cannot be adapted to provide for the attachment of a conventional flashlight thereto, as provided by the present flashlight holder.

U.S. Pat. No. 5,892,445 issued on Apr. 6, 1999 to Rudy G. Tomich, titled "Highway Worker Safety Signal Device," describes a rigid frame worn about the upper body and supporting a generally vertical rod extending upwardly therefrom. The upper end of the rod has a pair of strobe or other recognition type lights extending therefrom, well above the head of the wearer on a flexible extension. The battery pack for providing electrical power to the lights is remotely located on the lower portion of the frame of the device; thus, the Tomich device is not configured for holding a conventional flashlight. As noted in many of the devices discussed above, the omnidirectional nature of the Tomich lights obviates any requirement for a specific aiming mechanism, as provided by the present shoulder mounted flashlight holder invention.

U.S. Pat. No. 5,921,664 issued on Jul. 13, 1999 to Wen-Song Lee, titled "Reading Lamp," describes a small, self contained light and electrical power supply which is suspended from a lanyard worn about the neck of the user. No means is provided for aiming the light; rather, the light reflects from a mirror disposed in the lid of the device, when the lid is opened. The Lee device cannot be adapted to hold a conventional flashlight, as provided by the present shoulder mounted flashlight holder invention.

French Patent Publication No. 854,607 published on Apr. 19, 1940 to Matthew M. Houghton illustrates an electric light which may be clipped to a diagonal "Sam Browne" type belt. The light is separate from the electrical power supply, which is worn on the back of the waist belt. As the light is attached only by a pair of electrical cords, the light must be held by hand in the desired position for aiming it, unlike the present apparatus. The Houghton apparatus cannot be adapted for the carriage of a conventional flashlight, as provided by the present shoulder mounted apparatus.

Finally, Canadian Patent Publication No. 646,257 issued on Aug. 7, 1962 to Thomas F. Cote, titled "Adjustable Flashlight Holder," describes a generally diagonal strap which is worn over one shoulder, with a clip for attaching a flashlight thereto. Cote does not provide any means for adjusting and locking the aim of the flashlight, as provided by the present invention, and the single strap does not provide the security of the present invention.

None of the above inventions and patents, either singly or in combination, is seen to describe the instant invention as claimed.

SUMMARY OF THE INVENTION

The present invention comprises a shoulder mounted flashlight holder, enabling the user to work with both hands while having a light aimed at the work. The present flashlight holder essentially comprises a curved, rigid shoulder plate to which the base of a spherical adjustment mount is secured. The plate is well padded in a shoulder harness assembly for the comfort of the wearer. The shoulder harness assembly extends downwardly below the shoulder in front and in back, with an adjustable strap extending from the back of the harness and engaging an adjustable strap extending downwardly from the front of the harness. The present flashlight holder thus provides positive security about the upper body of the user, with its upper body encircling belt or strap and attachment to the shoulder harness portion precluding any slippage of the assembly and resulting misalignment of the light attached thereto.

The flashlight used with the present holder is conventional, having a generally cylindrical body housing one or more electrical storage cells therein. A rigid channel having a cylindrical opening at one end has a spherical ball extending therefrom, which adjustably engages the attachment fitting extending from the shoulder plate. A resilient elastomer woven sleeve is disposed about the channel, for holding the flashlight therein. The flashlight is installed in the present holder merely by inserting the end opposite the lens into the resilient sleeve, with the sleeve gripping the body of the flashlight securely therein and holding it in place within the underlying channel.

Accordingly, it is a principal object of the invention to provide an improved shoulder mounted flashlight holder for positively aiming and positioning a flashlight held therein, for hands free holding and aiming of the flashlight.

It is another object of the invention to provide an improved flashlight holder incorporating a rigid shoulder plate for holding a flashlight attached thereto above the shoulder of the wearer.

It is a further object of the invention to provide an improved flashlight holder which shoulder plate includes padding thereover and extending therefrom to comprise a shoulder harness assembly, and which includes a torso encircling strap or belt extending from the rear portion thereof and selectively engaging a strap depending from the front portion thereof to provide positive attachment.

An additional object of the invention is to provide an improved flashlight holder including a rigid channel having a resilient elastomer sleeve disposed therearound, for gripping a flashlight removably inserted therein.

Still another object of the invention is to provide an improved flashlight holder including means for positively locking the aim of a flashlight secured therein.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
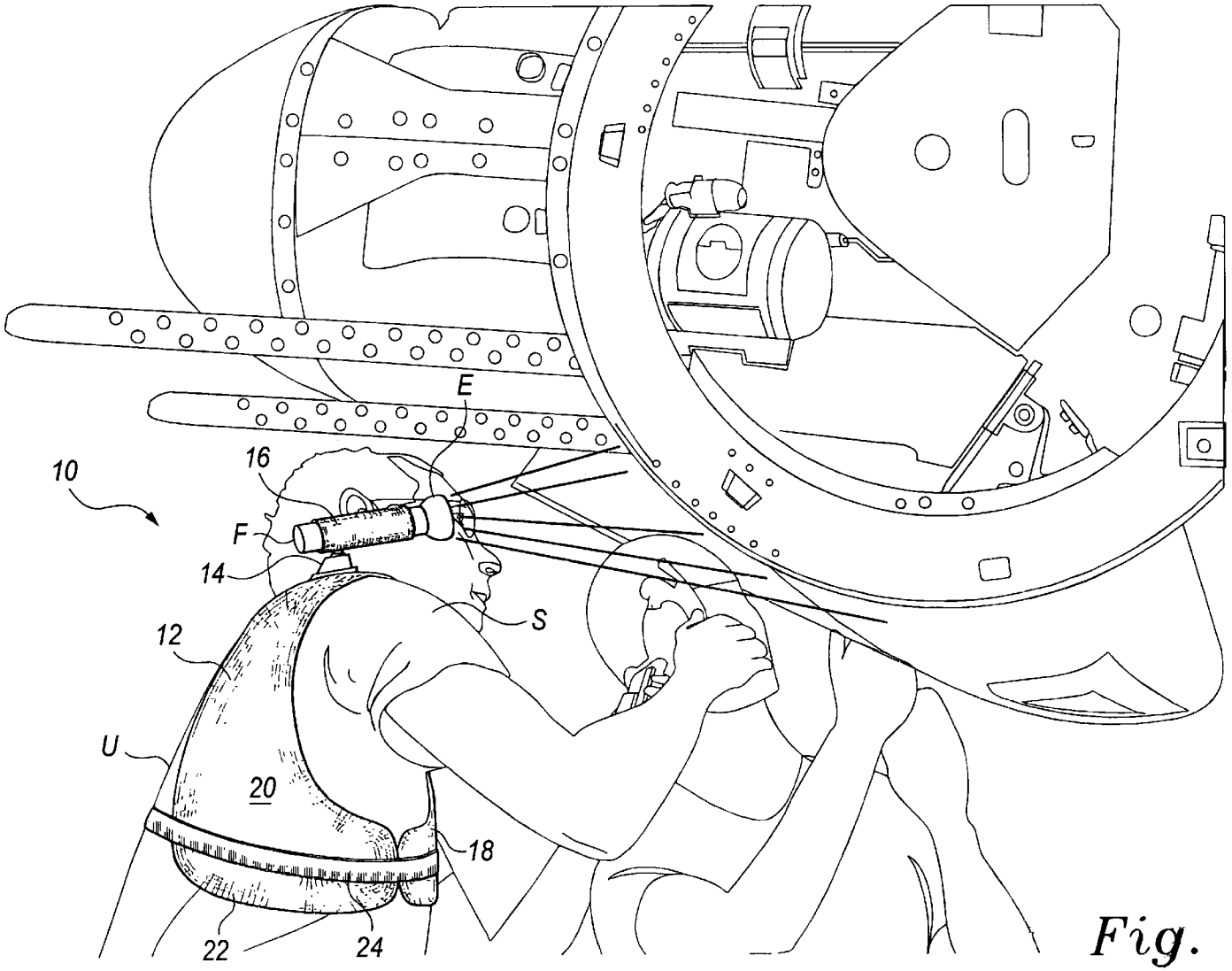
FIG. 1 is an environmental perspective view of the present shoulder mounted flashlight holder in use, showing its general function and operation.
Figure 4:
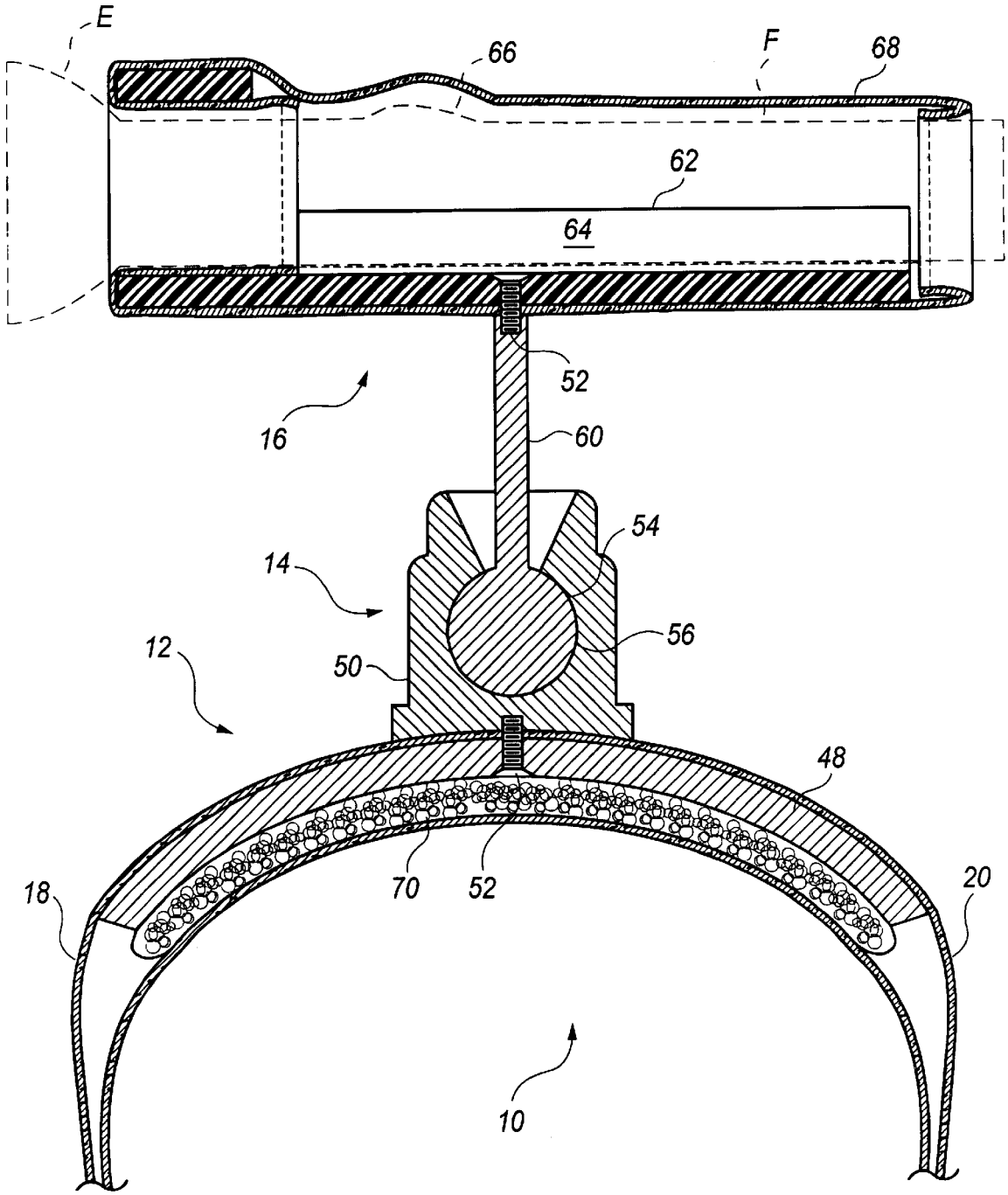
FIG. 4 is a side elevation view in section of the present flashlight holder, showing further construction details.

The present invention comprises a shoulder mounted flashlight holder, which enables the user or wearer to illuminate a specific area while keeping both hands free for the performance of a task. FIG. 1 of the drawings illustrates an exemplary use of the present flashlight holder 10, with the holder 10 being worn on the shoulder S of a user U of the device. The present shoulder mounted flashlight holder 10 essentially comprises a shoulder harness 12, which fits closely over the shoulder S of the user U of the device. The harness 12 includes a rigid plate which conforms closely to the curvature of the shoulder S and padding beneath the plate; these components are illustrated in FIG. 4 and discussed further below.

A flashlight holder mount 14 extends from the shoulder harness 12, with a directionally adjustable flashlight holder bracket 16 adjustably secured to the holder mount 14. The bracket 16 is configured for removably holding a conventional flashlight F therein, as shown in FIG. 1 of the drawings. Such flashlights F have a generally cylindrical body portion which serves to hold dry cells or other electrical storage elements therein, with a light emitting bulb and lens housed in a relatively larger diameter end E of the assembly, generally as shown in FIGS. 1 and 2 and in broken lines in FIG. 4 of the drawings.

Figure 2:
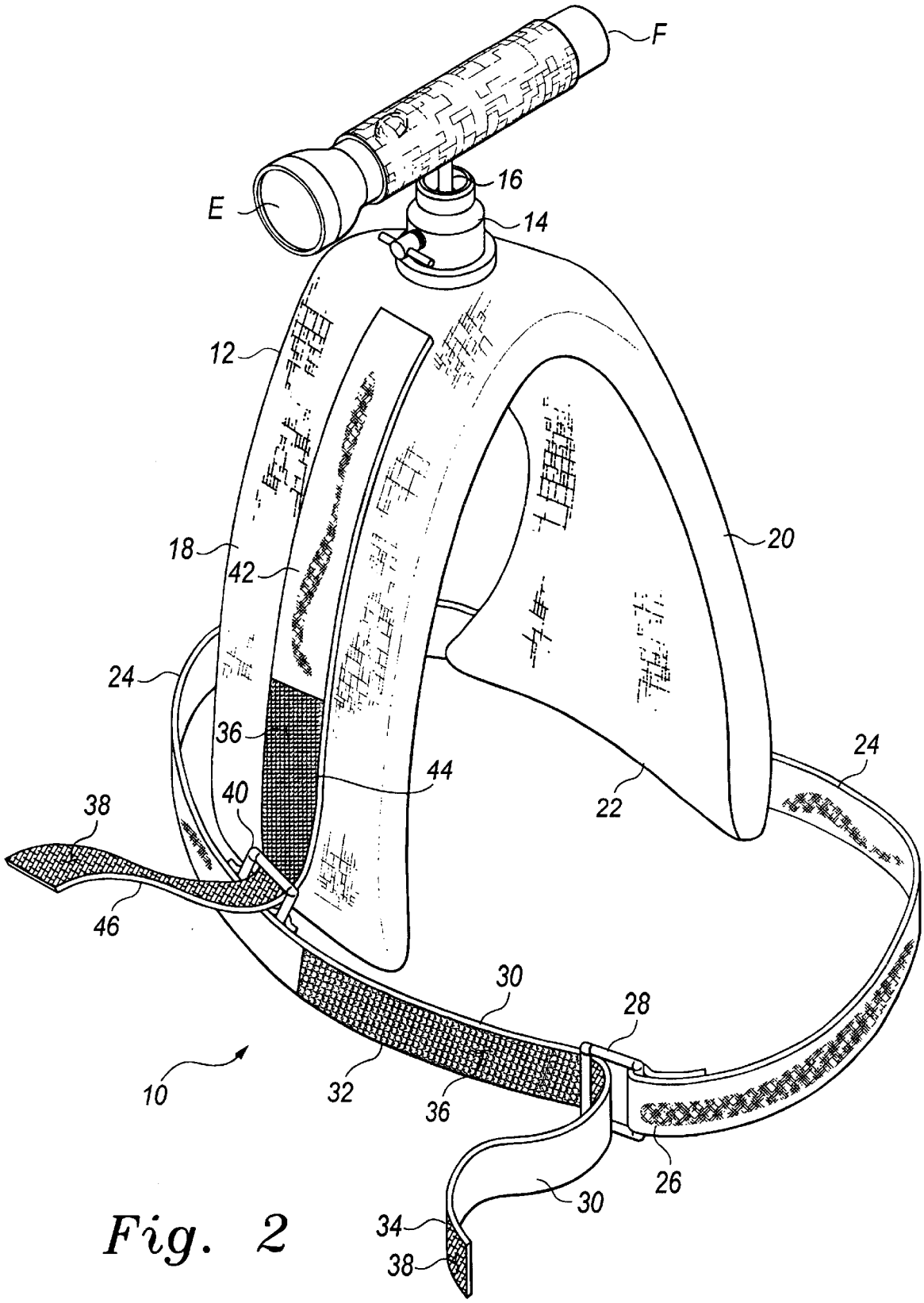
FIG. 2 is a front perspective view of the present shoulder mounted flashlight holder, showing further details thereof.

FIG. 2 of the drawings provides a more detailed front and left side perspective view of the present flashlight holder 10 than that available in FIG. 1. The shoulder harness 12 portion includes a front panel and a back panel, respectively 18 and 20, which depend from the upper central area to which the flashlight holder mount 14 is secured. The rearward panel 20 is somewhat wider near the lower portion 22 thereof, to extend at least somewhat beneath the arm of the wearer for greater security when secured about the upper torso of the wearer or user U.

An adjustable belt 24 is permanently secured to the lower portion 22 of the rear panel 20, and extends laterally in each direction therefrom for securing about the torso of a person using the present flashlight holder 10. The belt 24 has a first end 26 with a belt loop 28 extending therefrom, and an opposite second end portion 30 for inserting through the belt loop 28.

The second end portion 30 of the belt 24 has an outer surface with an intermediate portion 32 and distal portion 34. The intermediate portion 32 includes a first type of fastener material 36 disposed thereon, with the distal portion 34 including a mating second type of fastener material 38. The fastening means 36 and 38 may be hook and loop material (e.g., Velcro; tm), or other mating fasteners (conventional snaps, or buckle with pin engaging a hole in the opposite portion, etc.) as desired. The belt 24 is secured about the wearer's torso by passing the second end portion 30 of the belt 24 through the loop 28 of the first end 26, and doubling the distal portion 34 back over the intermediate portion 32 to engage their respective fastener materials 36 and 38. Removal is easily accomplished by pulling the two portions 32 and 34 apart, thus separating their mating fastener materials 36 and 38.

The second end portion 30 of the torso encircling belt 24 also has a strap securing loop 40 extending from the upper edge thereof, for accepting a front panel strap 42 which is permanently secured to and depends from the front panel 18 of the shoulder harness 12. The strap 42 is configured somewhat like the belt 24, with an intermediate portion 44 and a distal portion 46. The outer surface of the intermediate portion 44 includes a first type of fastening material 36 disposed thereon, with the outer surface of the distal portion having a mating second type of fastener material 38 disposed thereon; the fastener materials 36 and 38 may be selected from the same materials or means as used for securing the intermediate and distal portions 32 and 34 of the belt 24 together.

The strap 42 is secured to the belt 24 in much the same mariner as that used for securing the belt 24 about the torso of the wearer of the present flashlight holder 10, i.e., by passing the distal end portion 46 through the loop 40 extending from the upper edge of the torso belt 24 and doubling the distal end portion 46 back over the intermediate portion 44 to secure the two mating fastener materials 36 and 38 together, thus securing the holder 10 securely about the torso of the user of the device and provide a secure base for the flashlight F held therein to preclude movement of the light relative to the torso of the user. Removal of the strap 42 from the loop 40 is accomplished in the same manner as that used for loosening the torso belt 24 from the belt loop 28, i.e., pulling the mating fastener materials 36 and 38 apart to separate them.

Figure 3:
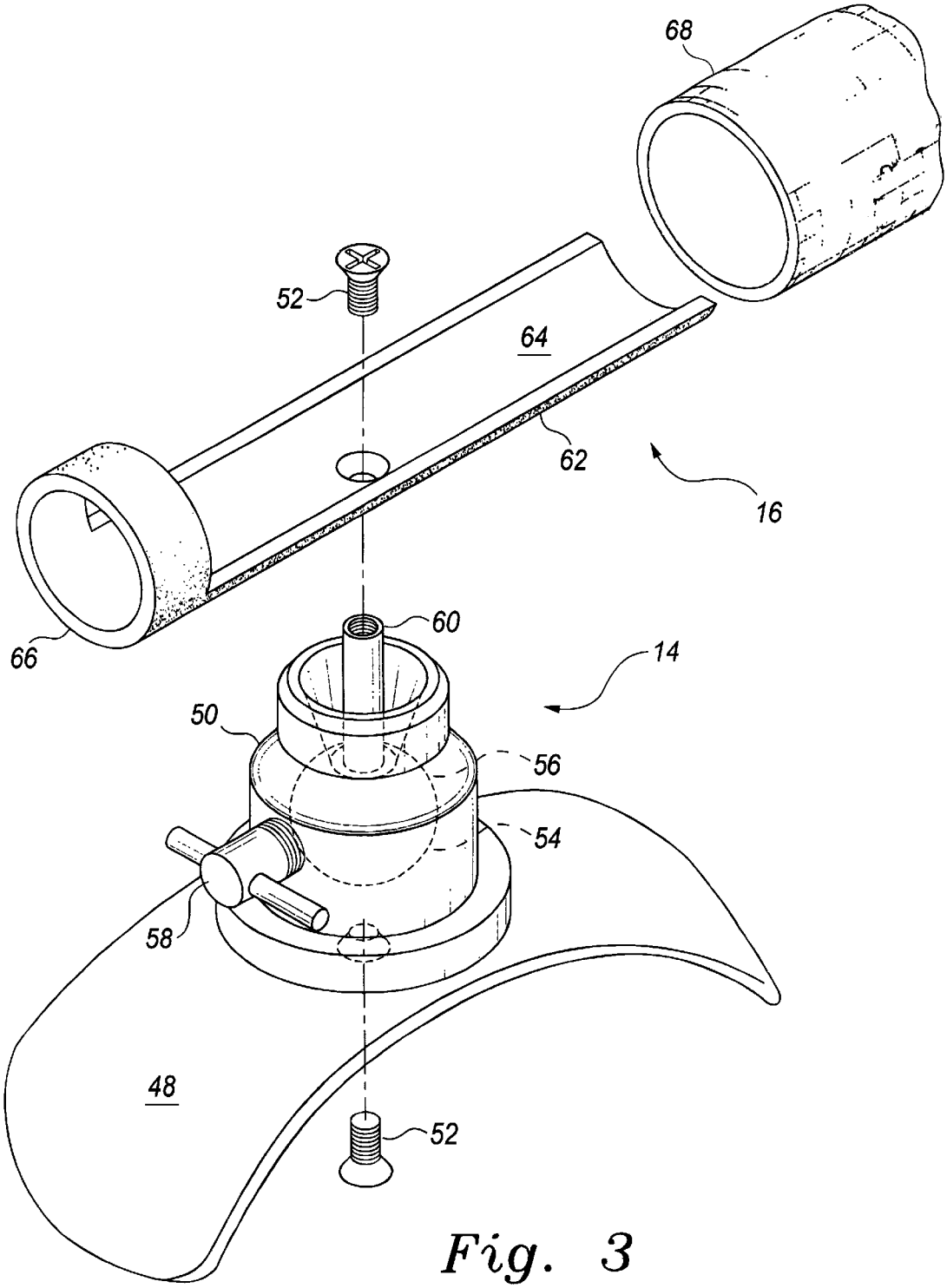
FIG. 3 is an exploded perspective view of the spherical adjustment means and flashlight holder channel of the shoulder support plate, showing details thereof.

FIGS. 3 and 4 of the drawings provide details of the flashlight mount assembly and its attachment to the plate 48 of the shoulder harness 12. The curved plate 48 is preferably formed of a rigid sheet of durable, yet relatively light weight, material. Aluminum works well, although certain relatively dense plastics or other materials may be used. The flashlight holder mount 14 essentially comprises a socket fitting, similar to those used with camera tripods for adjustably securing a camera to the tripod. The mount 14 includes a base 50 which is secured to the shoulder plate 48 by a screw 52 or other suitable fastener as required. The base 50 includes a spherical socket 54, into which a spherical fitting 56 is installed. Locking means 58 is adjusted to bear against the fitting 56 to lock its position in the socket 54.

The fitting 56 supports an extension 60 which extends from the top of the base 50. The extension 60 in turn attaches to a flashlight holder bracket 62 by means of another screw 52, or other suitable fastener means as required. Preferably, the two screws 52 are flathead screws which seat in countersunk depressions in their respective attachments, to preclude a protruding screw head from bearing against the shoulder of the user of the present device, and to preclude bearing against a flashlight held in the bracket 62.

The flashlight holder bracket 62 comprises a length of tubular pipe (PVC or other plastic, metal, etc.) which has been modified by cutting away a portion thereof to leave a semicylindrical channel 64 extending most of the length of the bracket 62. The forward end of the bracket 62 is left uncut to retain a concentric circular ring portion 66, which encircles the forward portion of the flashlight body when the flashlight is placed therein. A length of resilient elastomer material 68 (e.g., spandex fabric, etc.) is installed over the bracket 62, and wraps about the cylindrical ring portion 66 of the bracket 62. The forward end of the flashlight holder sleeve 68 may be secured to the ring portion 66 of the bracket 62 adhesively, or by other means as desired.

FIG. 4 illustrates an elevation view in section of the upper portion of the shoulder harness assembly 12 and the assembly comprising the flashlight holder mount 14 and bracket 16. The sectional view of FIG. 4 clearly illustrates all of the components of the upper portion of the present flashlight holder 10, with the exception of the means for locking the position if the flashlight relative to the remainder of the apparatus, which locking means is shown in FIGS. 2 and 3 of the drawings.

The tube forming the flashlight holder bracket 62 is selected so that its original, uncut diameter (and thus the diameter of the remaining ring portion 66 after cutting) is at least slightly larger than the body diameter of a flashlight F to be carried therein. However, the elastomer sleeve 68 is selected so that its unstretched diameter is somewhat smaller than the uncut diameter of the flashlight holder bracket 62, and smaller than the body diameter of a flashlight F to be carried therein. Thus, the forward end of the elastomer sleeve 68 must be stretched or distended to fit around the forward ring 66 of the holder bracket 62.

This serves to provide a secure grip for the flashlight F placed in the bracket 62 of the present holder 10, as the flashlight must be pushed physically into the relatively smaller diameter sleeve 68. (The sleeve 68 is shown with a diameter somewhat larger than that of the flashlight body in FIG. 4, to distinguish clearly between components for clarity in the drawing Figure.) However, the forward ring 66 holds the mouth of the elastomer sleeve 68 in a distended disposition, allowing the butt end of the flashlight F to be inserted therein easily without requiring a two hand operation. Yet, the diameter of the ring 66 is somewhat smaller than the lens or light emitting end E of the flashlight F, thus limiting the insertion of the flashlight F into the sleeve 68 to ensure a proper fit.

Other details will be noticed in FIG. 4, as well. As noted further above, the shoulder plate 48 is preferably formed of aluminum or other hard and rigid material, for adequate strength and durability. Accordingly, at least the underside of the plate 48 may include some form of padding means 70 (additional cloth layers, a sheet of open or closed cell foam, etc.) in order to provide comfort for the user of the present flashlight holder 10. The envelope comprising the shoulder harness 12, with its forward and rearward panels 18 and 20, may wrap completely around the plate 48 and its associated padding 70, in order to secure the various components in place relative to one another.

Another benefit of the configuration of the present flashlight holder bracket assembly 16, is that the flexible and pliable nature of the elastomer sleeve 68 permits the control switch C of the flashlight F to be accessed through the material of the sleeve 68. Thus, a user of the present shoulder mounted flashlight holder 10 may secure the device about his/her torso, as described further above, insert a flashlight F into the holder bracket channel 64 and its surrounding sleeve 68 in a one handed operation by means of the mouth provided by the forward ring 66 of the holder bracket 62, and easily manipulate the control switch C of the flashlight F through the resilient and pliable material used for the flashlight holder sleeve 68.

Accordingly, the present shoulder mounted flashlight holder provides a most convenient means of illuminating a work project or other area as desired, while keeping both hands free to perform the required task. The present flashlight holder is easily donned, with the harness and belt arrangement providing an extremely secure base for the flashlight mount upon the wearer or user of the present invention. Yet, the flashlight may be easily aimed as desired in any one of three arcuate degrees of freedom, and locked in position as desired. The novel means of holding the flashlight securely using a channel and resilient elastic sleeve, provides for one hand insertion or removal of a flashlight in the present holder and also allows the flashlight to be turned on or off without removal from the holder. The present shoulder mounted flashlight holder will thus prove to be a most valuable accessory for anyone who has occasion to perform any manual task in poorly illuminated or darkened conditions.

It is to be understood that the present invention is not limited to the sole embodiment described above, but encompasses any and all embodiments within the scope of the following claims.

I claim:

1. A shoulder mounted flashlight holder, comprising:

a shoulder harness including a rigid, curved shoulder plate for fitting over a shoulder;

protective padding means disposed over said shoulder plate;

said shoulder harness having a front panel and a rear panel each depending from said shoulder plate;

an adjustable belt extending from said rear portion of said shoulder harness, for encircling a torso;

a front panel strap depending from said front panel;

means for adjustably securing said front panel strap to said belt;

a flashlight holder mount extending from said shoulder plate; and a flashlight holder bracket adjustably secured to said flashlight holder mount, for removably holding a flashlight therein.

2. The flashlight holder according to claim 1, wherein:

said belt includes a first end and a second end portion;

a belt securing loop extending from said first end of said belt;

said second end portion of said belt having an outer surface with a distal portion and an intermediate portion;

said distal portion of said outer surface of said belt including first belt fastener means disposed thereon;

said intermediate portion of said outer surface of said belt including second belt fastener means disposed thereon;

said first and said second belt fastener means removably attaching to one another for securing said belt about the torso of a user when said second end portion of said belt is passed through said securing loop of said first end of said belt and doubled back upon itself for engaging said first belt fastener means with said second belt fastener means;

said second end portion of said belt having an upper edge with a strap securing loop extending therefrom;

said front panel strap having an outer surface with a distal portion and an intermediate portion;

said distal portion of said outer surface of said strap including first strap fastener means disposed thereon;

said intermediate portion of said outer surface of said strap including second strap fastener means disposed thereon; and said first and said second strap fastener means removably attaching to one another for securing said strap to said belt when said distal portion of said strap is passed through said strap securing loop of said belt and doubled back upon itself for engaging said first strap fastener means with said second strap fastener means.

3. The flashlight holder according to claim 1, wherein:

said flashlight holder mount includes a spherical socket; and said flashlight holder bracket includes a spherical fitting depending therefrom and adjustably engaging said socket of said flashlight mount.

4. The flashlight holder according to claim 3, including:

means for positionally locking said flashlight holder bracket fitting relative to said flashlight holder mount.

5. The flashlight holder according to claim 1, wherein:

said flashlight holder bracket comprises a semicylindrical channel for removably holding a flashlight therein.

6. The flashlight holder according to claim 5, wherein:

said channel includes a front end with a ring extending therefrom, with said ring and said channel having concentric axes;

a flexible elastomer flashlight holder sleeve extending around said channel and said ring; and said ring defining a flashlight holder opening for removably inserting a flashlight therein and said sleeve resiliently gripping the flashlight inserted in said holder.

7. The flashlight holder according to claim 1, wherein:

said shoulder plate is formed of metal and said flashlight holder bracket is formed of plastic.

8. A shoulder mounted flashlight holder, comprising:

a shoulder harness;

a flashlight holder mount extending from said shoulder harness;

a flashlight holder bracket adjustably secured to said flashlight holder mount;

said flashlight holder mount having a spherical socket therein;

said flashlight holder bracket having a spherical extension depending therefrom and adjustably engaging said socket of said flashlight holder mount;

said flashlight holder bracket comprising a semicylindrical channel for removably holding a flashlight therein;

said channel having a front end with a ring extending therefrom, with said ring and said channel having concentric axes;

a flexible elastomer flashlight holder sleeve extending around said channel and said ring; and said ring defining a flashlight holder opening for removably inserting a flashlight therein and said sleeve resiliently gripping the flashlight inserted in said holder.

9. The flashlight holder according to claim 8, including:

means for positionally locking said flashlight holder bracket fitting relative to said flashlight holder mount.

10. The flashlight holder according to claim 8, wherein:

said shoulder harness includes a rigid, curved shoulder plate for fitting over a shoulder;

protective padding means disposed over said shoulder plate;

said shoulder harness having a front panel and a rear panel each depending from said shoulder plate;

an adjustable belt extending from said rear portion of said shoulder harness, for encircling a torso;

a front panel strap depending from said front panel; and means for adjustably securing said front panel strap to said belt.

11. The flashlight holder according to claim 10, wherein:

said belt includes a first end and a second end portion;

a belt securing loop extending from said first end of said belt;

said second end portion of said belt having an outer surface with a distal portion and an intermediate portion;

said distal portion of said outer surface of said belt including first belt fastener means disposed thereon;

said intermediate portion of said outer surface of said belt including second belt fastener means disposed thereon;

said first and said second belt fastener means removably attaching to one another for securing said belt about the torso of a user when said second end portion of said belt is passed through said securing loop of said first end of said belt and doubled back upon itself for engaging said first belt fastener means with said second belt fastener means;

said second end portion of said belt having an upper edge with a strap securing loop extending therefrom;

said front panel strap having an outer surface with a distal portion and an intermediate portion;

said distal portion of said outer surface of said strap including first strap fastener means disposed thereon;

said intermediate portion of said outer surface of said strap including second strap fastener means disposed thereon; and said first and said second strap fastener means removably attaching to one another for securing said strap to said belt when said distal portion of said strap is passed through said strap securing loop of said belt and doubled back upon itself for engaging said first strap fastener means with said second strap fastener means.

12. The flashlight holder according to claim 8, wherein:

said shoulder plate is formed of metal and said flashlight holder bracket is formed of plastic.

13. A shoulder mounted flashlight holder and flashlight, comprising in combination:

a flashlight having a generally cylindrical body with a light emitting end extending therefrom;

said light emitting end having a larger diameter than said body;

a shoulder harness including a rigid, curved shoulder plate formed of metal for fitting over a shoulder;

protective padding means disposed over said shoulder plate;

means for securing said shoulder harness to a user;

a flashlight holder mount extending from said shoulder plate; and a flashlight holder bracket formed of plastic and adjustably secured to said flashlight holder mount, for removably holding said flashlight therein.

14. The flashlight holder and flashlight combination according to claim 13, wherein:

said shoulder harness includes a front panel and a rear panel each depending from said shoulder plate;

an adjustable belt extending from said rear portion of said shoulder harness, for encircling a torso;

a front panel strap depending from said front panel; and means for adjustably securing said front panel strap to said belt.

15. The flashlight holder and flashlight combination according to claim 14, wherein:

said belt includes a first end and a second end portion;

a belt securing loop extending from said first end of said belt;

said second end portion of said belt having an outer surface with a distal portion and an intermediate portion;

said distal portion of said outer surface of said belt including first belt fastener means disposed thereon;

said intermediate portion of said outer surface of said belt including second belt fastener means disposed thereon;

said first and said second belt fastener means removably attaching to one another for securing said belt about the torso of a user when said second end portion of said belt is passed through said securing loop of said first end of said belt and doubled back upon itself for engaging said first belt fastener means with said second belt fastener means;

said second end portion of said belt having an upper edge with a strap securing loop extending therefrom;

said front panel strap having an outer surface with a distal portion and an intermediate portion;

said distal portion of said outer surface of said strap including first strap fastener means disposed thereon;

said intermediate portion of said outer surface of said strap including second strap fastener means disposed thereon; and said first and said second strap fastener means removably attaching to one another for securing said strap to said belt when said distal portion of said strap is passed through said strap securing loop of said belt and doubled back upon itself for engaging said first strap fastener means with said second strap fastener means.

16. The flashlight holder and flashlight combination according to claim 13, wherein:

said flashlight holder mount includes a spherical socket therein; and said flashlight holder bracket includes a spherical fitting depending therefrom and adjustably engaging said socket of said flashlight mount.

17. The flashlight holder and flashlight combination according to claim 16, including:

means for positionally locking said flashlight holder bracket fitting relative to said flashlight holder mount.

18. The flashlight holder and flashlight combination according to claim 13, wherein:

said flashlight holder bracket comprises a semicylindrical channel for removably holding said flashlight therein.

19. The flashlight holder and flashlight combination according to claim 18, wherein:

said channel includes a front end with a ring extending therefrom, with said ring and said channel having concentric axes;

a flexible elastomer flashlight holder sleeve extending around said channel and said ring; and said ring defining a flashlight holder opening for removably inserting said flashlight therein and said sleeve resiliently gripping said flashlight inserted in said holder.

* * * * *